United States Patent [19]

Arrant

[11] Patent Number: 4,720,943

[45] Date of Patent: Jan. 26, 1988

[54] CORD STRUCTURE

[75] Inventor: Harold D. Arrant, Milton, Fla.

[73] Assignee: Monsanto Company, St. Louis, Mo.

[21] Appl. No.: 926,167

[22] Filed: Nov. 3, 1986

[51] Int. Cl.[4] ..... D02G 3/48; D02G 3/38

[52] U.S. Cl. ..... 57/210; 57/902

[58] Field of Search ..... 57/210, 212, 225, 227, 57/230, 243, 244, 902, 200, 206, 207, 222, 232, 3, 6, 18; 52/359

[56] References Cited

U.S. PATENT DOCUMENTS

| | | | |
|---|---|---|---|
| 913,856 | 3/1909 | Sloper | 57/210 |
| 939,839 | 11/1909 | Himes | 57/234 |
| 1,621,348 | 3/1927 | Boller | 57/210 |
| 2,598,033 | 5/1952 | Bourdon | 57/902 |
| 3,429,354 | 2/1969 | Brooks | 57/210 X |
| 3,805,508 | 4/1974 | Maderna | 57/902 |
| 3,831,369 | 8/1974 | Northup et al. | 57/210 |
| 4,018,042 | 4/1977 | Maag et al. | 57/210 |
| 4,074,512 | 2/1978 | Matt | 57/210 |
| 4,240,486 | 12/1980 | Schmit et al. | 57/210 X |
| 4,272,950 | 6/1981 | Bompard | 57/210 X |
| 4,299,884 | 11/1981 | Payen | 57/210 X |
| 4,333,507 | 6/1982 | Schmit et al. | 57/902 X |
| 4,343,343 | 8/1982 | Reuter | 57/210 X |
| 4,470,251 | 9/1984 | Bettcher | 57/902 |
| 4,544,603 | 10/1985 | Richards | 57/902 |
| 4,623,011 | 11/1986 | Kanuma | 57/250 X |

*Primary Examiner*—Donald Watkins

*Attorney, Agent, or Firm*—John W. Whisler

[57] ABSTRACT

Cord useful in the reinforcement of pneumatic tires is provided that is less expensive than conventional cord used for that purpose. A typical cord consists of a core composed of two continuous filament nylon yarns having little or no twist, laid side-by-side and held together by another continuous filament nylon yarn wound helically around the two core yarns.

15 Claims, 2 Drawing Figures

CORD STRUCTURE

BACKGROUND OF THE INVENTION

1. Field of the Invention

This invention relates to a polymeric cord structure for use in the reinforcement of articles such as pneumatic tires, hoses, belts, and other elastomeric articles. The cord has a core consisting of a single yarn or a plurality of continuous filament yarns laid side-by-side and a wrapper yarn wound helically around the core yarns.

2. Description of the Prior Art

Nylon and polyester tire cords are conventionally highly twisted structures consisting of two to five continuous filament, drawn, oriented yarns. The formation of these cords requires two twisting operations. The first operation is yarn twisting in which drawn, oriented yarn, containing only enough twist or tangle to hold the yarn together, is twisted on itself a desired number of turns per unit length of the yarn in either an S or Z direction. The second operation is cord twisting in which two or more of the twisted yarns prepared in the yarn twisting operation are twisted together. The direction of the twist in the cord twisting operation is opposite to that in the yarn twisting operation. Generally, the twist in the yarn and the twist in the cord have an equal number of turns, although more sophisticated twist relationships are possible. A typical nylon tire cord formed from two yarns each having a total nominal denier of 840 contains 12 turns per inch (tpi) of Z-twist in each of the two yarns and 12 tpi of S-twist in the cord. Such a cord is designated 840/2 (12×12). Other conventional nylon cords used in the construction of tires include 1260/2 (10×10) and 1890/2 (8×8). The yarn twisting and cord twisting operations are performed at slow yarn speeds (i.e. at about 15 to 20 yards per minute) and consequently add significantly to the cost of making tire cord (i.e. both operations add about twenty to forty cents per pound to the cost of the cord). It would be highly desirable to provide a less expensive tire cord.

SUMMARY OF THE INVENTION

This invention provides a cord that is particularly useful for reinforcement of pneumatic tires and which is significantly less expensive to make than conventional cord used for this purpose. The cord of the invention consists of (1) a core comprising a single yarn or a plurality of parallel yarns laid side-by-side, wherein each yarn of the core is drawn, oriented and is composed of continuous filaments of a synthetic polymer, such as nylon or polyester, and contains less than four turns of twist per inch of yarn length, and (2) a wrapper yarn wound helically around the core yarn(s) and forming helices along the length of the core which hold the core yarn(s) together. Winding of the wrapper yarn around the core tends to provide a core having a circular-shaped cross-section.

The cord of the invention offers cost saving advantages over conventional tire cord, for example, tire cord of the invention can be made in a single operation by merely laying a plurality of yarns side-by-side (core yarns) and wrapping another yarn (wrapper yarn) helically around the core yarns to hold the yarns together, thereby eliminating the costly yarn twisting and cord twisting operations used in making conventional tire cord. Cords of the invention can be made and collected at speeds in excess of 200 meters per minute (mpm). A particularly attractive feature of cord of the invention is that it can be made from readily available yarns, in fact, from conventional tire yarns.

DESCRIPTION OF THE PREFERRED EMBODIMENTS

Figure 1:
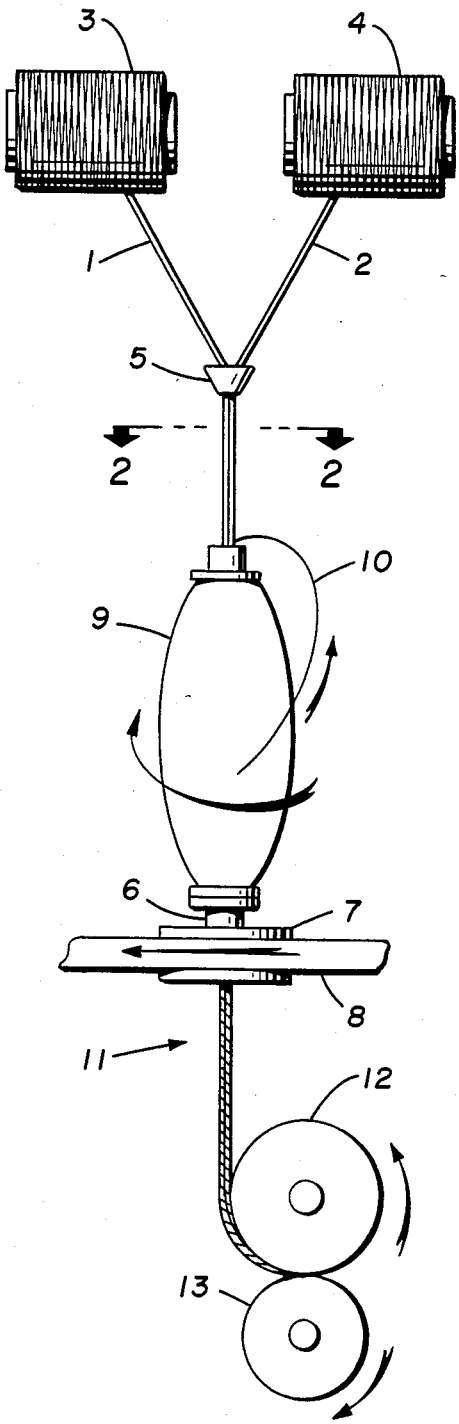
FIG. 1 is a schematic representation of one embodiment useful for making cord of the invention.

The cord of the present invention consists of (1) a core and (2) a wrapper yarn which holds the core together.

Preferably, the core consists of a plurality of parallel, drawn, oriented yarns laid side-by-side, each composed of continuous filaments of a synthetic polymer. Although yarns useful for making cord of the invention need not contain twist or tangle, the yarns preferably contain either a slight amount of twist (e.g. less than 4 tpi and usually less than 1 tpi) or tangle to give the yarns integrity to facilitate handling and processing of the yarn. The yarns may be made from any fiber-forming synthetic polymer. Such polymers include, but are not limited to: nylon, e.g., nylon 6 and nylon 66; aramid, e.g., poly(p-phenylene terephthalamide); polyester, e.g., polyethylene terephalate; and rayon. Particularly, preferred yarns for use in making cords of the present invention are commercially available nylon and polyester tire yarns.

The wrapper yarn may consist of a single filament or a plurality of filaments or a staple yarn. The filaments or fibers may be made from any suitable natural or man-made material, for example, cotton, steel or a synthetic fiber-forming polymer. According to one embodiment of the invention, the wrapper yarn and core yarn(s) are made from the same synthetic fiber-forming polymer.

Tire cords of the invention are conveniently made using commercially available nylon or polyester tire yarns for the core. These yarns are drawn, oriented and have a nominal total denier ranging from 500 to 2500, for example 840, 1260 or 1890, and a nominal denier per filament (dpf) of 6. The core is formed by laying two to five of the tire yarns parallel and side-by-side. The core may consist of yarns of the same or different total denier. A wrapper yarn is then wound helically around the core yarns so as to form helices which are preferably substantially evenly spaced apart along the length of the core. The wrapper yarn holds the core yarns together. Generally, the wrapper yarn will form from 1 to 8 helices per inch of length of the core yarns. The total nominal denier of the wrapper yarn may vary over a wide range for example, from 20 to 2500 or higher with a range of 20 to 1260 being preferred. The nominal denier per filament of the wrapper yarn preferably ranges from 2 to 10. According to one embodiment of the invention the wrapper yarn and core yarn(s) are identical, that is, of the same chemical composition and of the same nominal dpf and total denier. The nominal denier of the cord will usually be in the range of 1680 to 7560.

Figure 2:
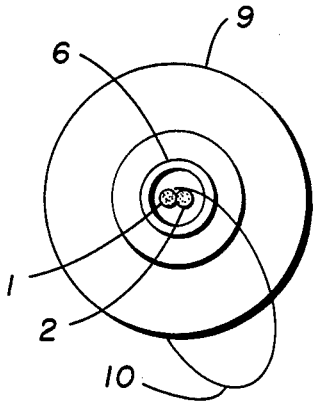
FIG. 2 is a section view taken along line II—II of FIG. 1.

The cords of the present invention may easily be made by using the apparatus shown in FIG. 1 which illustrates the making of a two-ply cord. Referring to FIG. 1, yarns 1 and 2 are withdrawn overhead from bobbins 3 and 4, respectively, and passed downwardly through convergence guide 5. From guide 5 yarns 1 and 2 are passed downwardly through hollow spindle 6. Spindle 6 is rotatable by an extended hub 7 that is frictionally engaged by drive belt 8 in a conventional manner, such as, by a variable speed motor that can operate in either a clockwise or counter clockwise direction. Bobbin 9 of wrapper yarn 10 is mounted on spindle 6 with the loose end of yarn 10 being attached to yarns 1 and 2. As yarns 1 and 2 pass through hollow spindle 6 (see FIG. 2), bobbin 9 rotates and wrapper yarn 10 is withdrawn from bobbin 9 and wound helically around yarns 1 and 2 forming spaced-apart helices. Cord 11 consisting of core yarns 1 and 2 and wrapper yarn 10 wound helically around yarns 1 and 2 is wound onto bobbin 12 by means of winding roll 13 in a conventional manner. When the speed at which wrapper yarn 10 is withdrawn from bobbin 9 and the speed at which cord 11 is wound onto bobbin 12 remains constant the helices are substantially evenly spaced from one another and the helix angle remains substantially the same. Cord 11 can be made at relatively high speeds, for example, cord 11 can be wound onto bobbin 12 at a speed of 200 meters per minute or higher. Spindle 6 can be rotated at speeds ranging from a slow speed (e.g. 100 rpm) up to a speed approaching the mechanical limitation of the spindle, e.g., 35,000 (rpm). For economical reasons, it is preferable to operate spindle 6 at its highest possible speed without causing mechanical difficulties and cord 11 is collected on bobbin 12 at a speed selected to produce a cord having the desired number of helices per inch of cord length.

According to one embodiment the core of the invention the core consists of a drawn, oriented single yarn composed of continuous filaments of a synthetic polymer, such as, for example, one of the core yarns described hereinbefore. In this instance, the cord is made in the same manner as just described except a single yarn, rather than a plurality of yarns, is passed through spindle 6.

The following example is given to further illustrate the invention.

EXAMPLE

Cord of the present invention was made using the arrangement of apparatus as substantially shown in FIG. 1. In making the cord, two commercially available continuous filament nylon 66 tire yarns, each having 0.3 turns of Z twist per inch of length, a nominal total denier of 1260 and a nominal denier per filament of 6 were passed from bobbins 3 and 4 through hollow spindle 6 and collected on bobbin 12. A wrapper yarn consisting of a continuous filament nylon 66 yarn having 0.3 turns of S twist per inch of length, a total denier of 30 and a dpf of 3 was wound helically around the two yarns forming evenly spaced-apart helices. The spindle was rotated at its maximum practical speed of approximately 35,000 rpm. The speed at which the cord was collected was varied to produce samples of cord in which the number of helices per inch of cord length was varied from 3 to about 7½ helices from sample to sample. This cord offers certain advantages over conventional twisted cord made from the same two yarns. Specifically the cord is less expensive to produce, has a higher modulus, a higher tenacity, and a lower elongation. Also, less of the cord in terms of weight is needed per tire. Additional cords were then made using the same apparatus and procedure except, instead of using tire yarns having a nominal total denier of 1260, in one instance commercially available nylon 66 tire yarns having a nominal total denier of 840 were used and in another instance commercially available nylon 66 tire yarns having a nominal total denier of 1890 were used.

In related experiments, nylon 66 cords, were prepared using the same general procedure and apparatus as described above, except in the making of certain of the cords more than two yarns were combined to form the core. In one instance three yarns were used and in another instance four yarns were used. In still another instance, eight yarns were combined to form the core, (two 840 denier yarns, two 1260 denier yarns and four 1890 denier yarns), and the wrapper yarn had a total denier of 60 and a dpf of 3. The resulting cord had a total denier of 11,850. In yet another instance, two 1260 yarns were combined to form the core and the wrapper yarn was also a 1260 yarn.

In preparing cords of the invention, core yarns may be used which contain up to about 4 tpi of twist and in which the direction of the twist (i.e., S or Z) may be the same in all the yarns or different from one yarn to the next. The wrapper yarn may be wound helically around the core yarns in either an S or Z direction without regard to the direction of the twist, if any, in the core yarns. It will be understood that the core yarns may contain tangle instead of twist or both or neither. The purpose of the twist and/or tangle is merely to facilitate handling of the yarns prior to forming of the cord.

According to one embodiment of the invention, the core yarns consist of aramid yarns containing little or no twist. Conventional aramid tire cords contain considerably more twist and, as a result have significantly less strength.

Cords prepared in the above example can be used in the construction of pneumatic tires in a conventional manner. Accordingly, the cords are loaded into a creel and from the creel are fed into looms for weaving into fabric. The cords become the warp and small fill threads are added to space the cords in the fabric. An adhesive is applied to the fabric and the fabric is then treated under electronically controlled conditions of time, temperature and tension. The fabric after being coated and impregnated with rubber in a calendering operation, is used in assembling of pneumatic tires.

I claim:

1. A tire cord comprising (1) a core consisting of at least one drawn, oriented yarn composed of continuous filaments of a synthetic polymer, wherein said drawn, oriented yarn(s) each contains less than four turns of twist per inch of yarn length and (2) a wrapper yarn wound helically around said core forming spaced-apart helices along the length thereof.

2. The cord of claim 1 wherein each yarn of said core contains from 0 to about 1 turn of twist per inch of yarn length.

3. The cord of claim 1 wherein each yarn of said core is tangled.

4. The cord of claim 1 wherein said synthetic polymer is nylon.

5. The cord of claim 4 wherein said continuous filaments each has a nominal denier of 6.

6. The cord of claim 4 wherein the total denier of the core is in the range of about 1680 to 7560.

7. The cord of claim 4 wherein said wrapper yarn forms from 1 to 8 helices per inch of core length.

8. The cord of claim 7 wherein said wrapper yarn is composed of nylon.

9. The cord of claim 8 wherein said core consists of a plurality of said drawn, oriented yarns laid side-by-side each having a denier ranging from 500 to 2500.

10. The cord of claim 9 wherein said nylon is nylon 66.

11. The cord of claim 10 wherein said wrapper yarn is a continuous filament nylon 66 yarn.

12. The cord of claim 11 wherein said wrapper yarn has a nominal denier ranging from 20 to 1260 and a nominal denier per filament of 6.

13. The cord of claim 4 wherein said core consists of a single yarn.

14. The cord of claim 13 wherein said single yarn contains less than about 1.0 turn of twist per inch of yarn length.

15. The cord of claim 13 wherein said singles yarn is tangled.

* * * * *